US005466552A

United States Patent [19]

Sato et al.

[11] Patent Number: 5,466,552

[45] Date of Patent: Nov. 14, 1995

[54] FERRITE CARRIER FOR ELECTROPHOTOGRAPHIC DEVELOPER AND DEVELOPER CONTAINING THE CARRIER

[75] Inventors: Yuji Sato; Toshio Honjo; Kanao Kayamoto; Masahiro Ogata; Kouichi Shimizu, all of Kashiwa, Japan

[73] Assignee: Powdertech Co., Ltd., Kashiwa, Japan

[21] Appl. No.: 292,886

[22] Filed: Aug. 19, 1994

[30] Foreign Application Priority Data

Jun. 7, 1994 [JP] Japan ..... 6-147008

[51] Int. Cl.[6] ..... G03G 9/107

[52] U.S. Cl. ..... 430/106.6; 430/108; 252/62.61

[58] Field of Search ..... 430/108, 106.6; 252/62.61

[56] References Cited

U.S. PATENT DOCUMENTS 3,370,011 2/1968 Kitagawa et al. ..... 252/62.61

4,623,603 11/1986 Iimura et al. ..... 430/108

4,898,801 2/1990 Tachibana et al. ..... 430/108

5,091,348 2/1992 Woodhead et al. ..... 252/62.61

5,162,187 11/1992 Lyons et al. ..... 430/108

*Primary Examiner*—Christopher D. Rodee

*Attorney, Agent, or Firm*—Bucknam and Archer

[57] ABSTRACT

A ferrite carrier for electrophotographic developers which comprises a lithium-based ferrite having the general formula $$(Li_2O)_x(Fe_2O_3)_{100-x}$$

wherein x is not more than 16.7 mole % and a part of $Li_2O$ and/or $Fe_2O_3$ is substituted with at least one member selected from the group consisting of alkaline earth metal oxides.

6 Claims, No Drawings

FERRITE CARRIER FOR ELECTROPHOTOGRAPHIC DEVELOPER AND DEVELOPER CONTAINING THE CARRIER

BACKGROUND OF THE INVENTION

1. Field of the Invention

This invention relates to a carrier for two-component electrophotographic developers and to a developer containing the carrier for use in copy machines, printers and the like.

2. Prior Art

Two-component developers used in electrophotography typically contain a toner and carrier. The carrier is such that it is mixed and agitated with the toner in a development box to impart a desired electrostatic charge to the toner particles and then carries the charged toner to static latent images on a photosensitive material to form corresponding toner images.

The carrier remains on a magnet and is recycled to the development box where the recycled carrier is again mixed and agitated with a fresh toner for repeated use.

Therefore, a carrier used in a developer is required as a matter of course to be unchanged and stable in characteristics and properties during its service period of time in order to enable the developer to maintain its desired image qualities (such as image density, fog, white spots or carrier scattering, gradation, and resolution) with minimal change and maximum stability not only at its initial stage of use but also during its entire period of use or service life.

In recent development system using a two-component developer, soft ferrites have been used as a carrier in place of conventional oxide-coated iron powder or resin-coated iron powder to obtain images of high quality. Typical of soft ferrites are $MO_a.M'O_b(Fe_2O_3)x$ wherein M and M' are each a metal element; and a, b and x are each an integer (The integer is a member like 1, 2, 3, 4 etc. A better way is to indicate x+a+b=1 (mol fraction)). Examples of the soft ferrites are Ni—Zn ferrite, Mn—Zn ferrite and Cu—Zn ferrite. These soft ferrite carriers have many of favorable properties for providing images of high quality as compared with iron powder carriers conventionally used; however, the use, in these carriers, of metals such as Ni, Cu and Zn has come to be avoided under rigorous environmental restrictions in recent years.

In view of environmental advantages, iron powder and magnetite powder carriers seem to be favorable. It is, however, difficult with these carriers to obtain an image quality and lifetime comparative to those obtained with the above mentioned soft ferrite carriers. From this standpoint, the ferrite carriers have been used widely, permitting their lifetime to be long as compared with the iron powder carrier. A further longer lifetime, however, has been desired.

From the viewpoint of environmental advantages, Li—Mn ferrites seem to be favorable among the ferrite carriers that have conventionally been proposed (Japanese Patent Application Laid-Open Gazette No. SHO 62-297857). Lithium, however, has not been used in practice because it is liable to be affected by its surroundings of, for example, temperature and humidity whereby it greatly varies in properties.

SUMMARY OF THE INVENTION

An object of the present invention is to overcome the above mentioned conventional problems, and to provide a carrier for an electrophotographic developer which is capable of forming images of high quality, is superior in durability, is environmentally benign, has a long lifetime, and is superior in environmental stability.

The present inventors had made intensive studies to overcome these problems and, as the result of their studies, they have found that the above mentioned object can be achieved by substituting a lithium based ferrite with a predetermined amount of an alkali earth metal oxide. The present invention was thus completed.

DETAILED EXPLANATION OF THE INVENTION

The present invention will now be explained hereunder in more detail.

A ferrite carrier for an electrophotographic developer according to the present invention is a lithium-based ferrite carrier characterized in that it has the following general formula $$(Li_2O)_x(Fe_2O_3)_{1-x},$$

wherein x is up to 16.7 mol %, preferably 5–16.7 mol %, and a part of the $Li_2O$ and/or $Fe_2O_3$ of the above formula has been substituted with at least one member selected from the group of alkaline earth metal oxides.

When the value of x which is stoichiometric ferrite, is more than 16.7 mol, the resulting ferrite carrier will greatly be affected by environmental variation and the image to be obtained will undesirably be greatly varied depending on that the temperature and humidity are high or low. In a case where the amount of $Li_2O$ of the ferrite carrier is not more than 16.7 mol %, the ferrite carrier is nearly equal to conventional Cu—Zn and Ni—Zn ferrite carriers in changes of amount of charge caused by environmental variations, and in addition to this, it is more stable than the conventional ones when subjected to endurance tests under high temperature and high humidity conditions which are the most disadvantageous conditions for the developers.

However, when the amount of $Li_2O$ is reduced relative to that of $Fe_2O_3$, the carrier particles are liable to differentiate in degree of magnetization from one another thereby to produce white spots, which are so-called carrier scattering, on the image obtained.

In the present invention, in order to overcome these disadvantages, a part of one or two of $Li_2O$ and $Fe_2O_3$ in the above general formula is substituted by at least one alkaline earth metal oxide preferably selected from the group consisting of MgO, CaO, SrO and BaO. By substituting a part of the lithium ferrite carrier by at least one alkaline earth metal oxide in the above manner, it is made possible that the carrier particles reduce their non-uniformity of magnetization thereby to greatly reduce carrier scattering due to great reduction of the dispersion of magnetization between the resulting ferrite carriers. Thus, there can be obtained ferrite carriers which are excellently stable in keeping a charge amount against environmental variation and are environmentally benign or safe. The present invention is based on this finding.

The amount of the alkaline earth metal oxide substituted by is preferably in the range of from 3 to 15 mol %. The substitution amount of 3 mol % or less is not preferable since the above mentioned effect cannot be achieved well. The substitution amount of 15 mol % or more is not preferable since the magnetization of the resulting carrier is lowered.

The ferrite carrier according to the present invention has an average particle diameter in the range of from about 15 to about 200 μm, preferably from 20 to 150 μm, and more preferably from 20 to 100 μm. The average particle diameter of smaller than 15 μm increases a proportion of fine powder in the carrier particle distribution, decreasing the magnetization per one particle and causing carrier scattering when the carrier is used in development. The average carrier particle diameter of larger than 200 μm reduces a specific surface area of the carrier. Such a particle diameter is not preferable because the toner scattering is caused upon development and the reproducibility of a black solid portion is deteriorated.

A method of producing the ferrite carrier of the present invention is described briefly.

$Fe_2O_3$, $Li_2O$ or $Li_2CO_3$ to be converted finally into $Li_2O$ and an alkaline earth metal additive (for example, alkaline earth metal oxide, carbonate or hydroxide) to be converted finally into its oxide, are collected together in such amounts that the resultant lithium-based ferrite has a composition consisting of 100 mol % of $Li_2O$, $Fe_2O_3$ and alkaline earth metal oxide in total with the amount of the $Li_2O$ being up to 16.7 mol %, preferably 5 to 16.7 mol %, and the amount of the alkaline earth metal oxide being preferably 3–15 mol %, after which the mass so collected together is incorporated with water and then ground and mixed over a period of at least 1 hour, preferably 1–20 hours, on a wet ball mill or a wet oscillating mill. The slurry so obtained is dried, further ground and subjected to preliminary firing at a temperature of from 700° to 1200° C. If a lower apparent density of the resulting carriers is desired, the preliminary firing may be omitted. The preliminarily fired powder is further ground into particles of 15 μm or smaller, preferably 5 μm or smaller, and more preferably 2 μm or smaller, in the wet ball mill, the wet oscillation mill, or the like, subsequently incorporated with a dispersing agent, a binder and the like, adjusted in viscosity and then granulated. The particles so obtained are kept for 1 to 24 hours at a temperature of from 1000° to 1500° C. for final firing.

The thus finally fired particles are ground and classified. If necessary, these particles may be somewhat reduced and then re-oxidized at the surface at a low temperature.

Next, the surface of the ferrite carrier so obtained according to the present invention is coated with a resin. The resin used for coating the lithium-based ferrite particles may be any one of adequate resins. The resins applicable to toners of positive charge include fluororesins, fluoroacrylic resins, and silicone resins. The resin for this purpose is preferably a silicone resin of a condensation type. The resins applicable to toners of negative charge include acryl-styrene resins, mixed resins of an acryl-styrene resin and melamine resin and hardening resins thereof, silicone resins, silicone acryl denatured resins, epoxy resins, and polyester resins. The resin for this purpose is preferably a hardening resin of an acryl-styrene resin and melamine resin, and a silicone resin of the condensation type. In addition, a charge control agent or a resistance control agent may be added if necessary.

The amount of the resin coated is preferably from 0.05% to 10.0% by weight, and more preferably from 0.1% to 7.0% by weight relative to the carrier which is a core material in this case. A uniform coating layer cannot be formed on the carrier surface when less than 0.05% by weight of the resin is used. The coating layer becomes excessively thick when more than 10.0% by weight of the resin is used. This may cause coagulation between the carrier particles, restricting production of uniform carrier particles.

In a typical method of resin coating, the resin is diluted in a solvent and then coated on the surface of the carrier core. The solvent used for this purpose may any one of adequate resin-soluble solvents. For a resin soluble in an organic solvent, these may be used a solvent such as toluene, xylene, Cellosolve butyl acetate, methyl ethyl ketone, methyl isobutyl ketone, or methanol. For a water-soluble resin or an emulsion type resin, water may be used as the solvent. The resin diluted with the solvent is coated on the surface of the carrier core through any one of adequate methods including dip coating, spray coating, brush coating, and kneading coating. The solvent is then volatilized from the surface. A resin in the form of powder may be applied to the surface of the carrier core through a dry method rather than the wet method using a solvent.

The carrier core coated with the resin is baked, if necessary, through either external heating or internal heating by using, for example, a fixed-bed electric furnace, a fluidized-bed electric furnace, a rotary electric furnace, or a burner furnace. Alternatively, the resin may be baked with microwaves. The baking temperature, which varies depending on the resin used, is required to be equal to or higher than the melting point or the glass transition point of the resin. If a thermoset resin or a condensation resin is used for coating, it should be heated to such a temperature at which sufficient level of hardening can be achieved.

The carrier core is coated with the resin and baked, chilled, crushed and then adjusted in particle size to obtain a resin-coated carrier.

The ferrite carrier according to the present invention is mixed with a toner for use as a two-component developer. The toner used herein is such that a coloring agent or the like is dispersed in a bonding resin. The bonding resin used for the toner is not particularly limited. Examples of the bonding resin are polystyrene, chloropolystyrene, styrene-chlorostyrene copolymers, styrene-acrylic acid ester copolymers, styrene-methacrylate copolymers, rosin-denatured maleic acid resins, epoxy resins, polyester resins, polyethylene resins, polypropylene resins and polyurethane resins. These resins may be used alone or jointly.

The charge control agent which may be used in the present invention may be any one of adequate ones. For the toner of positive charge, examples of the usable charge control agent are nigrosine dyes, and quaternary ammonium salts. For the toner of negative charge, metal-containing monoazo dyes and the like may be used.

Coloring agents usable herein may be conventionally known dyes and/or pigments. For example, the coloring agent may be carbon black, phthalocyanine blue, permanent red, chrome yellow or phthalocyanine green. The content of the coloring agent may be from 0.5% to 10% by weight relative to 100% by weight of the bonding resin. Additives such as fine powder of silica and titania may be added to the toner particles depending thereon to improve the toner in fluidity or anti-coagulating property.

A method of producing the toner is not particularly limited. The toner may be obtained by mixing-together, for example, the bonding resin, the charge control agent, and the coloring agent sufficiently in a mixer such as a Henschel mixer, melt kneading the mixture through, for example, a biaxial extruder, chilling the kneaded mixture, grinding the chilled mixture, classifying the ground mixture, incorporating the additives therein and then mixing the whole in a mixer or the like.

The present invention will be better understood by the following Examples and Comparative Examples.

EXAMPLES 1–4

14.0 mol % of $Li_2CO_3$, 77.0 mol % of $Fe_2O_3$, 6.8 mol % of $Mg(OH)_2$ and 2.2 mol % of $CaCO_3$ were ground and mixed on a wet ball mill over a period of 5 hours. The thus obtained mixture was oven dried and preliminarily fired at 900° C. for 1 hour. The thus preliminarily fired product was ground in the wet ball mill over a period of 7 hours to obtain a slurry having an average particle diameter of 3 μm. Suitable amounts of a dispersing agent and a binder were added to the slurry, which was then granulated and dried through a spray drier. The thus obtained dried granules were finally fired at 1240° C. for 4 hours in an electric furnace. Subsequently, the granules so finally fired were disaggregated and classified to obtain ferrite carrier core particles having an average particle diameter of 50 μm.

The thus obtained ferrite core particles were subjected to composition analysis. As a result, these core particles had a composition of 13.3 mol % of $Li_2O$, 6.5 mol % of MgO, 2.0 mol % of CaO and 78.2 mol % of $Fe_2O_3$ (Example 1).

The procedure of Example 1 was followed except that the mol % of each of $Li_2O$ and $Fe_2O_3$ was changed and a predetermined amount of $Mg(OH)_2$ was added without adding $CaCO_3$, thereby to obtain lithium ferrite carriers (Examples 2, 3 and 4).

Using these ferrite particles as the cores, a silicone resin (trade name SR-2411; 20 wt. % solid; manufactured by Dow Corning Toray Silicone Co., Ltd.) was dissolved in toluene as the solvent, coated on the ferrite cores in an amount of 0.6% by weight by using a fluidized-bed and then subjected to baking at 250° C. for 3 hours, thereby to obtain ferrite carriers coated with the above mentioned resin.

The lithium ferrite-carriers so coated with the resin were subjected to the following durability tests.

[Measurement of Change in Amount of Charge in Durability Test]

Changes in amount of charge were measured with a developer consisting of 27.78 g of the above carrier and 2.22 g of a toner (for Toshiba Leodry 9230 copier) placed in a glass vessel of 50 cc. The developer was agitated and stirred at 90 rpm by using a ball mill. A blow-off charge measuring device, manufactured by Toshiba Chemical Co., was used to measure the amount of charge.

The changes in amount of charge in the durability test were measured by calculating the formula $(1-B/A)\times 100(\%)$ wherein the charge amount (A) was obtained after two-minute agitation at 90 rpm under a high temperature and humidity (30° C., 80% RH) while the charge amount (B) was obtained after 30-hour agitation at 90 rpm under just the same temperature and humidity as above.

The results-thus obtained are shown in Table 1.

Comparative Examples 1–4

The procedure of Example 1 was followed except that an alkaline earth metal oxide was not used as a substituent and the mol % of each of $Li_2O$ and $Fe_2O_3$ was differentiated from that in Example 1, thereby to obtain comparative lithium ferrite carriers. These ferrite carriers were used as the cores, to coat a resin thereon. Thus, comparative lithium ferrite carriers coated with the resin were obtained in the same manner as in Example 1.

Changes in amount of charge were measured with a developer consisting of 27.78 g of the above carrier and 2.22 g of the same toner as used in Example 1 placed in a glass vessel of 50 cc. The developer was subjected to the durability test in the same manner as in Example 1 to find changes in amount of charge.

The results thus obtained are shown in Table 1.

Comparative Example 5

19.5 mol % of CuO, 26.5 mol % of ZnO and 54 mol % of $Fe_2O_3$ were treated in the same manner as in the Example 1 to obtain particulate cores of a Cu—Zn ferrite having an average particle diameter of 50 μm.

The thus obtained ferrite particles were subjected to compositional analysis. As a result, the ferrite particles were found to have a composition of 20.0 mol % of CuO, 25.0 mol % of ZnO and 55.0 mol % of $Fe_2O_3$.

The ferrite particles so obtained were used as the cores and coated with the same resin as used in Example 1. The resin was coated on the particles in the same amount in the same manner as in Example 1. The resin-coated particles were baked to obtain a ferrite carrier.

Changes in amount of charge were measured with a developer consisting of 27.78 g of the above Cu—Zn carrier and 2.22 g of the same toner as used in Example 1 placed in a glass vessel of 50 cc. The developer was subjected to the durability test in the same manner as in Example 1 to find changes in amount of charge.

The result thus obtained is also shown in Table 1.

TABLE 1

| | composition (mol %) | | | | rate of change between after agitation for 2 min (A) and after agitation for 30 hrs. (B) |
|---|---|---|---|---|---|
| | $Li_2O$ | $Fe_2O_3$ | MgO | CaO | $(1-B/A)\times 100$ (%) |
| Ex. 1 | 13.3 | 78.2 | 6.5 | 2.0 | 40 |
| Ex. 2 | 13.3 | 80.0 | 6.7 | | 43 |
| Ex. 3 | 16.7 | 78.6 | 4.7 | | 70 |
| Ex. 4 | 5.0 | 83.5 | 6.5 | 5.0 | 35 |
| Comp. Ex. 1 | 13.3 | 86.7 | | | 50 |
| Comp. Ex. 2 | 16.7 | 83.3 | | | 75 |
| Comp. Ex. 3 | 18.0 | 82.0 | | | 83 |
| Comp. Ex. 4 | 21.4 | 78.6 | | | 87 |
| Comp. Ex. 5 | Cu—Zn ferrite CuO = 20.0 ZnO = 25.0 $Fe_2O_3$ = 55.0 | | | | 80 |

EXAMPLES 5–10

In the same manner as in Example 1, lithium ferrite carriers were prepared so that they had compositions as shown in Table 2 by changing the composition ratios of $Li_2O$ to $Fe_2O_3$ and adding a predetermined amount of alkali earth metal additives to be converted respectively into their oxides.

These ferrite particles were used as the cores to coat them with the resin in the same manner as in Example 1 thereby to obtain resin-coated lithium ferrite carriers.

[Changes in Amount of Charge due to Environmental Fluctuations]

The resin-coated lithium ferrite carriers were treated to prepare developers (the time of agitation on the ball mill being 30 min.), respectively, in the same manner as mentioned in the previous paragraph [Measurement of Change in Amount of charge in Durability Test] in the heading of Examples 1–4. The developers so prepared were subjected to measurement for their amount of charge (QLL) after left to stand still for 24 hours under environmental conditions of 10° C. and 20% RH, and for their amount of charge (QHH) after left to stand still for 24 hours under environmental conditions of 30° C. and 80% RH, thereby to find a difference ΔQ, i.e., $$\Delta Q = QLL - QHH (\mu c/g)$$

in order to assess environmental dependency of the amount of charge.

The results thus obtained are shown in Table 2.

Comparative Examples 6–9

The procedure of Example 1 was followed to obtain lithium ferrite carriers (Comparative Examples 6–8) with no alkali earth metal oxide being substituted for and the compositional ratio of $Li_2O$ to $Fe_2O_3$ differentiated from that in Example 1. In addition, in the same manner as in Example 7, a lithium ferrite carrier containing MnO in place of BaO was prepared (Comparative Example 9). Using these ferrite particles as the cores, lithium ferrite carriers coated with the resin were obtained in the same manner as in Example 1.

The resin-coated lithium ferrite carriers were treated to prepare developers (the time of agitation on the ball mill being 30 min.), respectively, in the same manner as mentioned in Examples 5–10.

Changes in amount of charge due to the environmental fluctuations were obtained on these developers in the same manner as in Examples 5 through 10.

The results thus obtained are shown in Table 2.

Comparative Example 10

The resin-coated Cu—Zn ferrite particles prepared in Comparative Example 5 were treated to prepare a developer (the time of agitation on the ball mill being 30 min.), in the same manner as mentioned in Examples 5–10.

A change in amount of charge due to the environmental fluctuations was obtained on the developer in quite the same manner as in Examples 5 through 10.

The result thus obtained is shown in Table 2.

EXAMPLE 11–25

In the same manner as in Example 1, lithium ferrite carriers were prepared so that they had their respective compositions as shown in Table 3 by changing compositional ratios of $Li_2O_3$ to $Fe_2O_3$ and adding a predetermined amount of alkaline earth metal additives to be converted into their respective oxides.

The ferrite particles so obtained were used as the cores and coated with the same resin as used in Example 1 in the same amount and in the same manner as in Example 1. The resin-coated particles were then baked to obtain ferrite carriers.

The resin-coated lithium-based ferrite carriers so obtained were subjected to a test for their amount scattered.

The amount of the carrier scattered was tested in the following manner: 600 g of the sample were placed in a development box in a Leodry 7610 copier manufactured by Toshiba Co. The sample was agitated and stirred for 5 minutes by using a motor at a rotation speed of 158 rpm. A portion of the sample, which was scattered out of the development box during the agitation, was recovered and weighed.

The results thus obtained are shown in Table 3.

Comparative Examples 11–24

The procedure of Example 1 was followed to obtain lithium ferrites with the compositional ratio of $Li_2O$ to $Fe_2O_3$ being changed (Comparative Examples 16 and 18) as set forth in Table 3 and further obtain lithium ferrite carriers (Comparative Examples 11–15, 17 and 19–24) prepared by adding a minute amount of an oxide such as CuO, MnO, $Bi_2O_3$, $SiO_2$, $Al_2O_3$ or $V_2O_5$ to said lithium ferrite.

These ferrite particles so obtained were used as the cores and coated with the same resin as used in Example 1. The resin was coated on the particles in the same amount and in the same manner as in Example 1. The resin-coated particles were baked to obtain resin-coated ferrite carriers.

The resin-coated lithium-based ferrite carriers were subjected to a test for their scattered amount in the same manner as in Examples 7–18.

TABLE 2

| | composition (mol %) | | | | | | | difference in charge amount (μc/g) |
|---|---|---|---|---|---|---|---|---|
| | $Li_2O$ | $Fe_2O_3$ | MgO | CaO | BaO | SrO | MnO | L/L–H/H |
| Ex. 5 | 5.0 | 83.5 | 6.5 | 5.0 | | | | 2.7 |
| Ex. 6 | 13.3 | 78.5 | 6.5 | 2.0 | | | | 3.0 |
| Ex. 7 | 13.3 | 80.0 | 6.9 | | | | | 3.1 |
| Ex. 8 | 16.7 | 78.6 | 4.7 | | | | | 3.8 |
| Ex. 9 | 16.7 | 78.6 | | | 4.7 | | | 4.0 |
| Ex.10 | 16.7 | 78.6 | | | | 4.7 | | 3.9 |
| Comp. Ex. 6 | 13.3 | 86.7 | | | | | | 5.3 |
| Comp. Ex. 7 | 16.7 | 83.3 | | | | | | 6.2 |
| Comp. Ex. 8 | 18.0 | 82.0 | | | | | | 8.5 |
| Comp. Ex. 9 | 16.7 | 78.6 | | | | | 4.7 | 6.4 |
| Comp. Ex.10 | Cu—Zn ferrite CuO: 20.0 ZnO: 25.0 $Fe_2O_3$: 55.0 | | | | | | | 5.5 |

L/L: low temperature and low humidity (10° C. × 20% RH)
H/H: high temperature and high humidity (30° C. × 80% RH)

The results thus obtained are shown in Table 3.

Comparative Example 25

A change in amount of charge due to the environmental fluctuation was obtained on the resin-coated Cu—Zn ferrite particles which were prepared in Comparative Example 5, in the same manner as in Examples 11–25.

The results thus obtained are shown in Table 3.

TABLE 3

| Examples and Comparative Examples | Composition (mol %) | | | | | | | | | | | | magnetization of carrier (emu/g) at 3000 Oe | amount scattered (mg) |
|---|---|---|---|---|---|---|---|---|---|---|---|---|---|---|
| | $Li_2O$ | $Fe_2O_3$ | MgO | CaO | BaO | SrO | CuO | MnO | $Bi_2O_3$ | $SiO_2$ | $Al_2O_3$ | $V_2O_5$ | | |
| Ex. 11 | 12.0 | 83.3 | 2.5 | | | | | | | | | | 59 | 58.0 |
| Ex. 12 | 12.0 | 83.3 | 4.7 | | | | | | | | | | 61 | 46.0 |
| Ex. 13 | 12.0 | 78.6 | 4.7 | 4.7 | | | | | | | | | 62 | 8.2 |
| Ex. 14 | 12.0 | 83.3 | | | 4.7 | | | | | | | | 44 | 7.0 |
| Ex. 15 | 12.0 | 83.3 | | | | 4.7 | | | | | | | 51 | 4.0 |
| Comp. Ex. 11 | 12.0 | 83.3 | | | | | 4.7 | | | | | | 59 | 621.0 |
| Comp. Ex. 12 | 12.0 | 83.3 | | | | | | 4.7 | | | | | 55 | 1823.0 |
| Comp. Ex. 13 | 12.0 | 83.3 | | | | | | | | 4.7 | | | 50 | 2380.0 |
| Comp. Ex. 14 | 12.0 | 83.3 | | | | | | | | | 4.7 | | 48 | 585.0 |
| Comp. Ex. 15 | 12.0 | 83.3 | | | | | | | | | | 4.7 | 16 | ‡ |
| Ex. 16 | 13.3 | 79.2 | 6.5 | 1.0 | | | | | | | | | 60 | 15.0 |
| Ex. 17 | 13.3 | 78.2 | 6.5 | 2.0 | | | | | | | | | 61 | 25.0 |
| Ex. 18 | 13.3 | 80.0 | 6.7 | | | | | | | | | | 60 | 17.0 |
| Ex. 19 | 13.3 | 78.7 | 6.7 | | | 1.3 | | | | | | | 56 | 12.5 |
| Ex. 20 | 13.3 | 74.0 | 6.7 | 4.7 | | 1.3 | | | | | | | 60 | 10.0 |
| Ex. 21 | 13.3 | 76.7 | 10.0 | | | | | | | | | | 55 | 7.0 |
| Comp. Ex. 16 | 13.3 | 86.7 | | | | | | | | | | | 62 | 531.0 |
| Comp. Ex. 17 | 13.3 | 86.7 | | | | | | 4.7 | | | | | 58 | 1151.0 |
| Ex. 22 | 16.7 | 78.6 | 4.7 | | | | | | | | | | 58 | 24.0 |
| Ex. 23 | 16.7 | 78.6 | | 4.7 | | | | | | | | | 68 | 31.0 |
| Ex. 24 | 16.7 | 78.6 | | | 4.7 | | | | | | | | 43 | 3.0 |
| Ex. 25 | 16.7 | 78.6 | | | | 4.7 | | | | | | | 49 | 6.0 |
| Comp. Ex. 18 | 16.7 | 83.3 | | | | | | | | | | | 63 | 51.0 |
| Comp. Ex. 19 | 16.7 | 78.6 | | | | | 4.7 | | | | | | 58 | 60.0 |
| Comp. Ex. 20 | 16.7 | 78.6 | | | | | | 4.7 | | | | | 61 | 144.0 |
| Comp. Ex. 21 | 16.7 | 78.6 | | | | | | | 4.7 | | | | 58 | 284.0 |
| Comp. Ex. 22 | 16.7 | 78.6 | | | | | | | | 4.7 | | | 61 | 67.0 |
| Comp. Ex. 23 | 16.7 | 78.6 | | | | | | | | | 4.7 | | 51 | 68.0 |
| Comp. Ex. 24 | 16.7 | 78.6 | | | | | | | | | | 4.7 | 39 | ‡ |
| Comp. Ex. 25 | Cu—Zn ferrite CuO: 20.0 ZnO: 25.0 FeO: 55.0 | | | | | | | | | | | | 62 | 58.0 |

Note: The symbol, ‡, indicates that it is impossible to test due to collapse of the shape at the time of firing.

As will be understood from Comparative Examples 11–25 in Table 3, there is a tendency that the amounts of the carrier scattered increase with the decrease of the amount of $Li_2O$. Comparing Examples 11–25 with Comparative Examples 11–25, it is recognized that the amounts of the alkaline earth metal oxide-containing lithium-based ferrite carrier scattered are remarkably reduced as compared with those of the other compositions (said Comparative Examples) containing no alkaline earth metal oxide when the carriers of said Examples and those of said Comparative Examples have the same $Li_2O$ content (mol %).

[Effects of the Invention]

As mentioned above, according to this invention there can be obtained a lithium ferrite carrier for electrophotographic developers which is capable of at least equally maintaining its durability as compared with a conventional ferrite carrier and is excellent in stability against environmental fluctuations, by substituting a part of a lithium-based ferrite carrier core containing $Li_2O$ in a predetermined controlled concentration with a predetermined amount of at least one alkaline earth metal oxide. In addition, the lithium ferrite carrier for the electrophotographic developers according to the present invention permits a wide range of choice of design to obtain desired image properties upon development, and is capable of complying with rigorous environmental restrictions.

What is claimed is:

1. A ferrite carrier for electrophotographic developers which comprises a lithium ferrite having the formula $$(Li_2O)_x(Fe_2O_3)_{100-x}$$

wherein x is not more than 16.7 mole % and 3 to 15 mole %, based on said lithium ferrite, of $Li_2O$ and/or $Fe_2O_3$ is substituted with at least one member selected from the group consisting of alkaline earth metal oxides.

2. The ferrite carrier according to claim 1, wherein said alkaline earth metal oxide is MgO, CaO, SrO or BaO.

3. The ferrite carrier according to claim 1 of average particle diameter 15–200 μm.

4. A ferrite carrier according to claim 1, wherein the surface of said ferrite carrier is coated with 0.05%–10% by weight of a resin.

5. An electrophotographic developer comprising a toner and a ferrite carrier, said carrier comprising a lithium ferrite having the formula $$(Li_2O)_x(Fe_2O_3)_{100-x}$$

wherein x is not more than 16.7 mole % and 3 to 15 mole %, based on said lithium ferrite, of $Li_2O$ and/or $Fe_2O_3$ is substituted with at least one member selected from the group consisting of alkaline earth metal oxides.

6. The electrophotographic developer according to claim 5, wherein said ferrite carrier has a surface, and the surface is coated with a resin.

* * * * *